US006179964B1

(12) United States Patent
Begemann et al.

(10) Patent No.: US 6,179,964 B1
(45) **Date of Patent: *Jan. 30, 2001**

(54) METHOD AND CONTROL DEVICE FOR PAPER WEB PROFILE CONTROL WITH PLURALITY OF SENSORS

(75) Inventors: Ulrich Begemann, Heidenheim; Rudolf Münch, Königsbreen Zang, both of (DE)

(73) Assignee: Voith Sulzer Papiermaschinen GmbH (DE)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/922,995

(22) Filed: Sep. 2, 1997

(30) Foreign Application Priority Data

Aug. 30, 1996 (DE) ..... 196 34 997

(51) Int. Cl.[7] ..... D21F 11/00

(52) U.S. Cl. ..... 162/198; 162/198; 162/DIG. 10; 162/252; 162/253; 162/263; 162/259; 364/471.01; 364/471.03

(58) Field of Search ..... 162/198, 252, 162/253, 263, 259, DIG. 10; 364/471.01, 471.03

(56) References Cited

U.S. PATENT DOCUMENTS

| | | | | |
|---|---|---|---|---|
| 3,936,665 | * | 2/1976 | Donoghue | 235/151.3 |
| 4,374,703 | | 2/1983 | LeBeau et al. . | |
| 4,921,574 | * | 5/1990 | Hu | 162/198 |
| 5,071,514 | | 12/1991 | Francis . | |
| 5,298,121 | | 3/1994 | Kilmister . | |
| 5,466,340 | | 11/1995 | Begemann et al. | 162/216 |

FOREIGN PATENT DOCUMENTS

| | | |
|---|---|---|
| 2102374 | 11/1993 | (CA) . |
| 2019975 | 11/1971 | (DE) . |
| 3001980 | 1/1980 | (DE) . |
| 3741680 | 12/1987 | (DE) . |
| 4019593 | 6/1990 | (DE) . |
| 4239845 | 11/1992 | (DE) . |
| 4239845 | 5/1993 | (DE) . |
| WO 8911561 | 11/1989 | (WO) . |
| WO 9103600 | 3/1991 | (WO) . |
| WO 9619615 | 6/1996 | (WO) . |

* cited by examiner

*Primary Examiner*—Peter Chin
*Assistant Examiner*—Mark Halpern
(74) *Attorney, Agent, or Firm*—Ostrolenk, Faber, Gerb & Soffen, LLP

(57) ABSTRACT

The invention relates to a closed-loop control device and a method for the control of the cross-machine and/or machine direction profile of at least one quality feature in the paper manufacturing process with the aid of two sensors. The first sensor picks up a first measured signal of the cross-machine and/or machine direction profile of a first quality feature of the paper web produced. A second sensor picks up a further measured signal. The further sensor is suitable for picking up a quality feature that differs from that picked up by the first sensor, or measures the first quality feature. One or both sensors traverse the web separately. The sensors act through a controller on actuators leading to the feed line or lines for the suspension leading to the flowbox of the machine for controlling thereby the first quality feature of the process.

34 Claims, 6 Drawing Sheets

METHOD AND CONTROL DEVICE FOR PAPER WEB PROFILE CONTROL WITH PLURALITY OF SENSORS

BACKGROUND OF THE INVENTION

The invention relates to a control device and a method for the setting/closed-loop control of a cross-machine and/or machine direction profile of a quality feature in the paper manufacturing process.

Control systems which have been used for the cross-machine and/or machine direction profile of a quality feature in the paper manufacturing process. For example, the grammage was controlled as the quality feature. The grammage of the running paper web was measured at the papermaking machine by a sensor, for example a traversing sensor. The measured variable was read into an open-loop/closed-loop control device to control the cross-machine direction profile. Through a control program, the open-loop/closed-loop control device drove actuators to influence the cross-machine direction grammage profile. An open-loop/closed-loop control device of this type and a method of controlling the grammage and fiber orientation cross-machine direction profile are disclosed in DE-OS 42 39 845. This discloses a method of making adjustments at the headbox of a web-forming machine to provide a web of relatively uniform density and layer height utilizes a headbox with a plurality of transverse sections, each of which is provided with a web material at a variable flow rate and a variable consistency. The method includes the steps of measuring the layer height profile of the web, measuring the density profile of the web, and comparing a portion of the layer height profile with a corresponding portion of the density profile to determine whether there are corresponding deviations in the profiles. If there are deviations in the layer height and density profiles, the consistency and flow rate of the web material provided to the headbox are adjusted, based on deviations in the layer height profile and stock density profile and whether the deviations correspond with each other, in order to achieve a uniform stock density profile and layer height profile. The web is preferably dewatered by providing it to a dewatering apparatus, pressed and dried to provide a finished web, and rolled into a roll. The method may be used in connection with a paper machine to form a paper web.

The prior art discloses a flowbox or headbox that is constructed at least partially in sections arrayed in the cross-machine direction. The flowbox influences the paper stock suspension in the individual sections, particularly as to its consistency and its fiber orientation, by feeding dilution water, for example, to control the cross-machine direction grammage profile. Sectional flowboxes are disclosed in allowed U.S. application Ser. No. 08/662,980 now U.S. Pat. No. 5,707,495, and U.S. Pat. No. 5,466,340 whose contents are incorporated by reference herein.

The achievable level of the cross-machine direction profile quality feature, the grammage in the present example, using a cross-machine direction control system of this type, was limited, particularly by the fluctuations occurring during paper manufacturing, in the machine direction profile of the quality feature of the paper web. The main cause of machine direction fluctuations, if the cross-machine direction grammage profile is considered, are volume flow fluctuations and consistency fluctuations in the stock jet.

A traversing sensor that operates point by point, as in DE 42 39 845, to pick up the measured signal relating to the quality feature of the paper web cannot precisely ascertain the cross-machine direction profile of the quality feature.

Instead, it is only possible to determine a signal that is composed of cross-machine and machine direction profile components. This results from the speed at which the paper web runs through the papermaking machine, which is generally greater than 1000 m/min.

The measurement signal, which includes mixed cross-machine and machine direction components, can be used for the control device for the open-loop/closed-loop control, if it is viewed as a cross-machine direction profile signal which is "averaged" over a certain machine direction section of the paper web. However, such averaging over a certain paper section leads to a very "noisy" cross-machine direction profile measured signal. An actual cross-machine direction profile is extracted by filters from this noisy cross-machine direction profile measured signal, and the extracted actual cross machine direction profile is used for control. The severe filtering of the cross-machine direction profile measurement signal enables control interventions of the cross-machine direction profile control system to be performed only infrequently or with too low an amplitude. Thus, control interventions according to the prior art are performed only after a very long time delay in relation to the measurement, for example only after five minutes after picking up the measured signal. At a web production speed of 1500 m/min, for example, this means that the paper web has travelled a distance of 7500 m before a control intervention is performed. This produces problems, for example, the transient behavior of the control system is severely slowed and the attainable cross-machine direction profile is limited by the random component on account of the machine direction fluctuations in the cross-machine direction profile.

In order to solve this problem, German Application DE-AS 20 19 975 proposes using both a stationary sensor and a sensor traversing over the web width for sending the thickness measurement of a web. The two sensors pick up a thickness profile of the web which is passing by. The stationary sensor measures the thickness profile in the machine direction at one point along the web, while the traversing sensor measures the thickness profile on a path running obliquely over the web. The obliquely running profile contains both components of the pure cross-machine direction profile and components of the pure machine direction profile. By subtracting the machine direction profile from the oblique profile, the pure cross-machine direction profile is then determined. Disadvantages of this method or device are that too much time elapses for complete measurement of a cross-machine direction profile and that the thickness of the paper web can only be measured at the end of the papermaking machine. It produces an excessively long or sluggish reaction time for the control system.

SUMMARY OF THE INVENTION

The object of the invention is to provide a control device and a method which overcomes the disadvantages of the prior art.

The invention relates to a control device preferably closed-loop and a method for the control of the cross-machine and/or machine direction profile of at least one quality feature in the paper manufacturing process with the aid of two sensors. The first sensor picks up a first measured signal of the cross-machine and/or machine direction profile of a first quality feature of the paper web produced. The second sensor picks up a further measured signal of a quality feature that differs from that picked up by the first sensor. The sensors transverse the web separately. The sensors act through a controller on actuators leading to the feed line or lines for the suspension leading to the flowbox for controlling thereby the quality features of the process. In some embodiments, the two sensors measure the same quality feature differently. For example, in measuring grammage, one sensor measures the cross-machine direction profile while the other measures the machine direction profile; or each sensor measures cross-machine, but they traverse the web on respective time paths, e.g. one trails the other, or they move in opposite directions.

By measuring more than one quality feature using more than one sensor and by using more than one sensor for separate measurements of the moving web being produced, it is possible to now pick up a profile of the web closer to the flowbox supplying the suspension for forming the web and to react more rapidly to fluctuations in the machine direction profile. Furthermore, by using more than one traversing sensor to control the cross-machine and/or machine direction profile of a quality feature of the web, for example, the grammage in the paper manufacturing process, it is also possible to determine the cross-machine direction profile more rapidly from the noisy profile data. The cross-machine direction profile control system can then intervene more frequently and react more rapidly to profile fluctuations. An additional advantage is that the transient behavior of the control system is shortened significantly, which is of decisive advantage, particularly following a grade change or following process disturbances. It is also possible for more than two sensors to be used in a control device of even more complicated construction.

Using the device and the method according to the invention, it is possible to control the cross-machine and/or machine direction profiles of the widest possible range of quality features in the paper manufacturing process.

Thus, the control of the cross-machine and/or of the machine direction profile of any and all of the following quality features in the paper manufacturing process is enabled without restricting the process:

the formation of the paper web;

the thickness of the running paper web;

the moisture and opacity of the running paper web;

the roughness and the mechanical sheet properties of the paper web, such as the modulus of elasticity or the breaking length ratio, for example.

Control over the cross-machine and/or machine direction profile of the grammage and of the fiber orientation of the paper web is particularly preferred. In a particularly advantageous embodiment, a controlled consistency flowbox is used as an actuator for the cross-machine direction grammage profile or the cross-machine direction profile of the fiber orientation.

A flowbox of this type is sectioned along the cross-machine direction, and the paper stock suspension consistency and fiber orientation are able to be respectively influenced in the individual sections. This is enabled, for example, by arranging dilution lines, which open into the feed lines, in the region of the feed lines to the respective sections. Each dilution line is equipped with a control valve. Both the consistency and also the fiber orientation in the individual sections can then be influenced via the dilution lines. Flowboxes of this type are disclosed in the above mentioned DE 40 19 593 and, respectively, DE-A 43 16 054.

In one embodiment of the invention, a control valve is arranged in the common feed to the flowbox or else in the common return, as the actuator for the machine direction profile control system.

It is particularly advantageous if the at least two measured signals from the at least two measuring sensors be fed to a computer device. At least one measured signal contains both a cross-machine and a machine direction profile component. By means of the computer device, the measured signals can be processed in such a way that a cross-machine direction profile component and a machine direction profile component, as well as a residual component which describes the random disturbances, can be extracted from the measured signals that are picked up. The resulting control signal for the machine direction component is fed to a controller for the machine direction profile control, and the resulting signal for the cross-machine direction component is fed to a cross-machine direction profile controller. The cross-machine or machine direction profile controller then in turn addresses the respective actuators in accordance with its control algorithm. As mentioned above, in controlling the grammage cross-machine and/or the machine direction profile, an advantageous embodiment uses a controlled consistency flowbox, whereas a control valve that is arranged in the common flowbox or, respectively, in the discharge, and that is addressed by the machine direction profile controller, can be provided as the actuator for the machine direction profile.

In a particular embodiment of the invention, the paper stock consistency in the flowbox itself is determined as a further measured signal containing only a machine direction profile component. The paper stock consistency can be measured either in the common feed to the flowbox or else in the individual feed lines.

An alternative embodiment uses the signal from a further sensor which is arranged at the wet end of the papermaking machine as the further measured signal. The further sensor is able to measure the level or depth of the suspension on the fabric or wire of the papermaking machine, which fabric follows the flowbox. A fluctuation in the level of the suspension on the fabric results from fluctuation in the volume of flow. For a constant paper stock consistency, that fluctuation changes the grammage in the corresponding region of the web width. In addition, a paper stock consistency sensor can be provided in the feed lines to the flowbox. With the aid of the latter sensor, in conjunction with the measurement of the level of the suspension, a reliable statement can be made about the amount of paper stock which is being ejected in the corresponding region. The quantity of stock being ejected is directly associated with the grammage at the location and can easily be used as a measure of quality. Conclusions can be drawn about the longitudinal profile of the grammage. Hence, measurement of one feature, e.g. quantity of stock, can be used to adjust another feature, e.g. grammage.

Furthermore, it is also possible to determine the mass flow at the wet end of the papermaking machine, using a radiometric measurement, in particular in the gamma radiation range, and to use this measured variable of the mass flow as a further measured variable to determine the machine direction and cross-machine direction profile of the grammage.

A particular advantage of making the measurement at the wet end of the papermaking machine or, respectively, of measuring the paper stock consistency in the flowbox itself, is that it enables very rapid control to be achieved, because deviations in the flowbox are determined more rapidly than previously by means of a sensor arranged in this area, and this leads to the control system making an intervention. In other words, this means that such an arrangement has a shorter dead time and a shorter controlled system.

In a particularly cost effective and simple embodiment, a sensor arranged outside the flowbox may be of identical construction to the first sensor, to serve as the further sensor.

In principle, there are two particularly advantageous variants, relating to use of a plurality of the sensors. In one embodiment, both sensors traverse the cross machine direction at a specific offset in time, that is, the sensors are at different locations over the paper web at the same time and each sensor picks up one measured signal.

In a simplified second variant one of the two sensors remains fixed at one point, while the other sensor traverses across the paper web.

The invention also provides a method for setting/closed-loop control of a cross-machine and/or machine direction profile of a quality feature in paper manufacture. In addition to a first measured signal relating to the cross-machine and/or machine direction profile of the one quality feature, a further measured signal of another quality feature is picked up. Furthermore, the invention provides a method in which two profiles, both containing both machine direction and cross-machine direction components of at least one quality feature, are evaluated to obtain the pure machine direction and cross-machine direction profiles and, accordingly, to drive at least one of the actuators of at least one control device in order to influence one of the measured quality features.

Features mentioned above and explained below can be used not only in the respectively specified combination but also in other combinations or on their own.

Other objects and features of the present invention will become apparent from the following description of the invention which refers to the accompanying drawings.

DETAILED DESCRIPTION OF THE INVENTION

Figure 1:
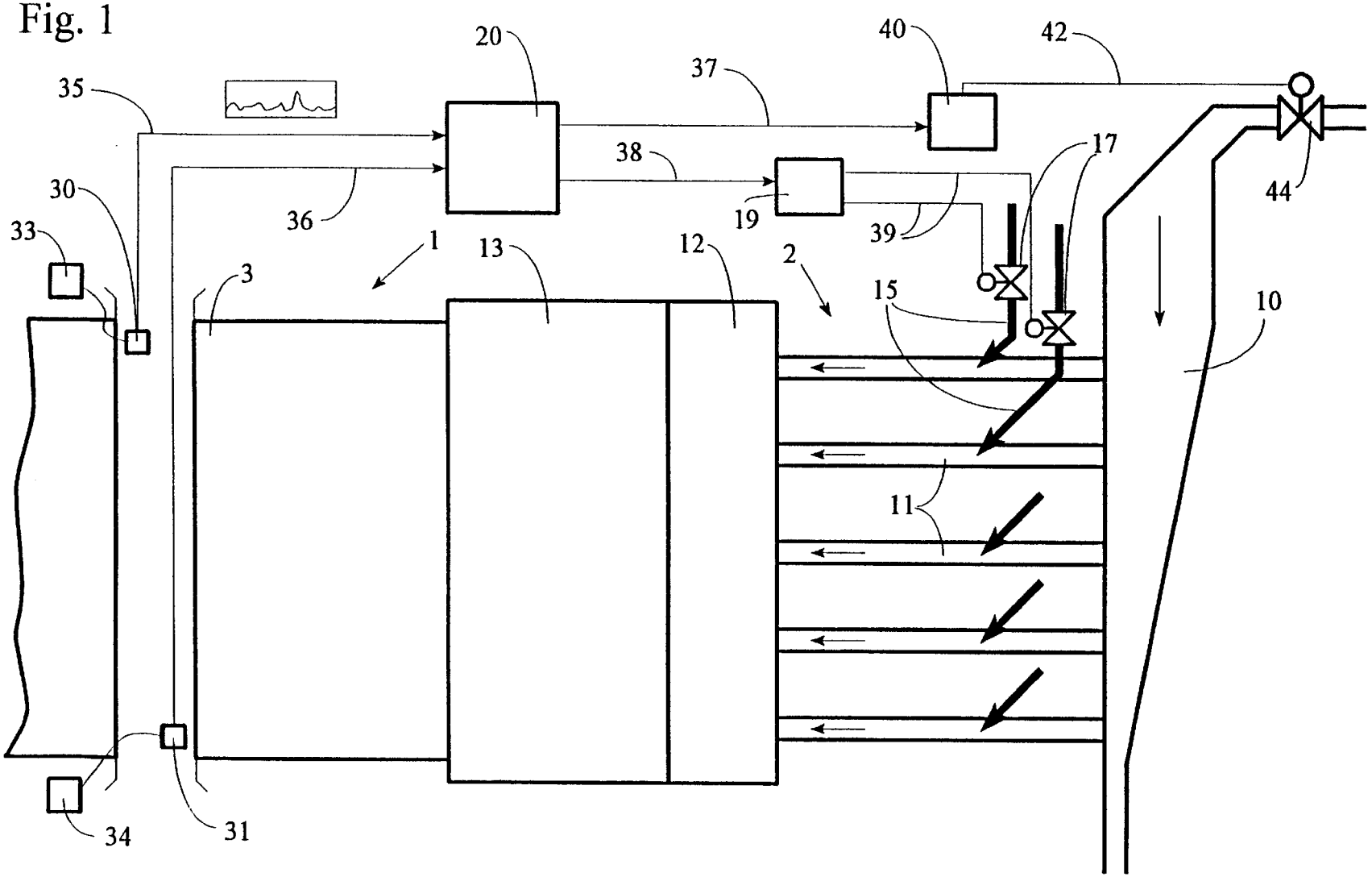
FIG. 1 schematically shows a part of a papermaking machine with the control device according to the invention and two traversing sensors.

FIG. 1 schematically shows a control device, fitted to a papermaking machine 1, for the setting/closed-loop control of the cross-machine and/or machine direction profile of a quality feature in the paper manufacturing process according to the invention. The setting/closed-loop control according to the invention is described below for example using the machine direction grammage and/or cross-machine direction grammage profile of a paper web. This measurement example is not intended to be taken as a restriction in relation to the general idea of the invention.

The general idea of the invention is that at least two measured signals for the profile of a quality feature in the paper manufacturing process are picked up.

For a traversing sensor traversing over a running paper web, the measured signal of the quality feature profile is composed of a cross-machine direction profile component, a machine direction profile component and a random or residual component. For a stationary or locally fixed sensor, the signal is only of a machine direction profile component. In addition to the grammage profile, other quality features can be used for the control of a paper manufacturing process: the fiber orientation, formation, ash content, thickness, moisture, opacity, roughness of the paper web or other mechanical sheet properties, such as the modulus of elasticity.

For a control system which uses the machine direction grammage and/or the cross-machine direction grammage profile or the fiber orientation as the measured signal, it is possible, for example, to use a sectioned flowbox for the cross-machine direction profile component and a control valve arranged in the flowbox feed line for the machine direction component as the actuator.

FIG. 1 illustrates an arrangement including a papermaking machine flowbox or headbox 2 and the initial section of the paper web 3, which runs on a fabric in the forming section for the purpose of dewatering. The flowbox 2 comprises a common feed line 10 for the paper stock suspension to be fed. That feed line divides into individual feed lines 11 leading to respective sections of the flowbox 2. The individual feed lines 11 open into a turbulence generator 12, which is followed by the slice 13 of the flowbox, from which the paper stock suspension emerges and passes onto a fabric or wire on which the paper web 3 is formed. These features of a flowbox are known in the art, e.g., U.S. application Ser. No. 08/662,980 filed Jun. 13, 1996 now U.S. Pat. No. 5,707,495, incorporated herein by reference.

The difference in speeds between the emerging stock jet and the moving fabric of the forming section has an influence on the fiber orientation in the running paper web. Any difference in speed produces a preferred orientation of the fibers in the machine running direction of the paper web. If cross-machine flows exist, and in the absence of differences in speed between the emerging stock jet and the fabric, it is possible for fiber orientations, which deviate by an angle a from the machine running direction, may be produced in the sheet on account of cross-machine direction speed components. Based on the above relationship, the present control device enables control over the fiber orientation in addition to the grammage as a quality feature in the paper manufacturing process by appropriately driving a sectioned flowbox, as described below, as an actuator for the cross-machine direction profile.

A respective dilution means feed line 15 opens into each of the individual feed lines 11 of the flowbox. Each line 15 has a control valve 17 fitted into it. FIG. 1 shows the control valves only for the first two dilution means feed lines 15 of the flowbox. A similar arrangement is also provided for the other lines, although it is not illustrated. The dilution means feed lines 15 enable dilution means or medium, for example dilution water or else diluted paper stock suspension, to be selectively introduced into individual sections of the flowbox, so that both the consistency and the fiber orientation can be changed in the individual sections of the flowbox. These changes in turn influence, for example, the cross-machine direction grammage profile of the paper web that is formed by applying the stock suspension to the fabric. With the aid of a sectioned, controlled consistency flowbox, it is thus possible to set the cross-machine direction grammage profile and the fiber orientation in a deliberate manner. Control is performed by means of appropriately opening and closing the actuator in the form of the control valve 17 for each individual feed line. The actuation of the control valve 17 is performed by means of a control pulse from the controller 19, which in turn is addressed by a control computer 20.

Figure 2:
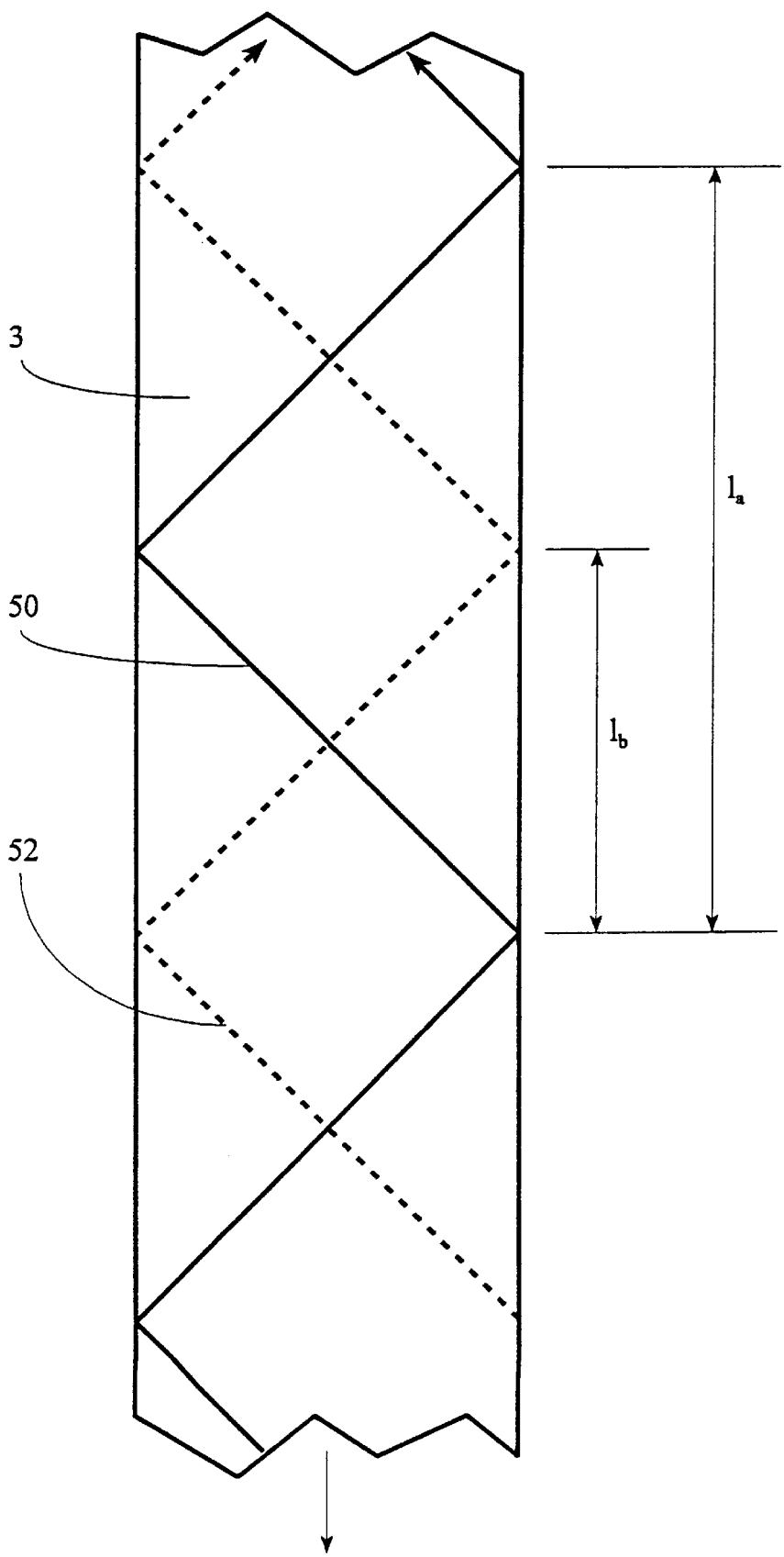
FIG. 2 shows a paper web and schematically illustrates the path followed by two traversing measuring sensors over the paper web.

The task of the control computer is described. At least two sensors pick up measured signals in order to determine the cross-machine and/or the machine direction grammage profile. In the embodiment illustrated, these two sensors comprise two point like measurement points 30 and 31, respectively, which are arranged above the paper web on a measuring frame and which are spaced from each other in the machine direction. The sensors can be moved transverse to the running direction of the paper web and over the web on the measuring frame 32. The measuring sensors may be driven, for example by respective electric motors 33, 34. In moving transversely across the web, the sensors pick up the cross-machine direction profile of the running paper web 3 point by point. However, because the paper web is running, over time this does not produce a pure cross-machine direction profile as the measured signal, but it instead produces a profile which is composed of both a cross-machine component and a machine direction profile component, as illustrated in FIG. 2. There are numerous possibilities for crossmachine direction movement of two traversing sensors. Thus, the two point-like sensors 30 and 31 may move in the same direction over the paper web at a certain distance from each other or they may be synchronized precisely in time to be able to move in opposition to each other.

The values that are picked up by the measuring sensors are transmitted via measuring line 35, 36 to the control computing unit 20. In the control computing unit 20, the measured signals from the at least two sensors 30 and 31 are processed in such a way that the cross-machine direction profile components and, respectively, the machine direction profile components are extracted from the signals, with the exception of a residual component. The cross-machine and machine direction profile components determined in this way are compared with the respective desired profile data, and then the respective controllers for the cross-machine and the machine direction profile component are addressed via the closed-loop controller lines 37, 38. In order to set the cross-machine direction profile, controller 19 controls the individual control valves 17 of the respective sections of the flowbox. For this purpose, individual control lines 39 lead from the controller 19 to the respective control valves. For a method of influencing the grammage profile and the fiber orientation cross-machine direction profile by means of a controlled-consistency flowbox, refer to German patent DE 40 19 593, whose disclosure is incorporated herein by reference.

The controller 40 for controlling the machine direction profile controls the control valve 44 via the control line 42. In this embodiment, the control valve 44 is arranged in the common feed line 10, on the inlet side, and is used to control the amount of paper stock suspension in the common feed. This enables the machine direction profile to be influenced, since machine direction profile fluctuations in the grammage profile or in the fiber orientation profile may be caused by consistency fluctuations in the flowbox.

Figure 1A:
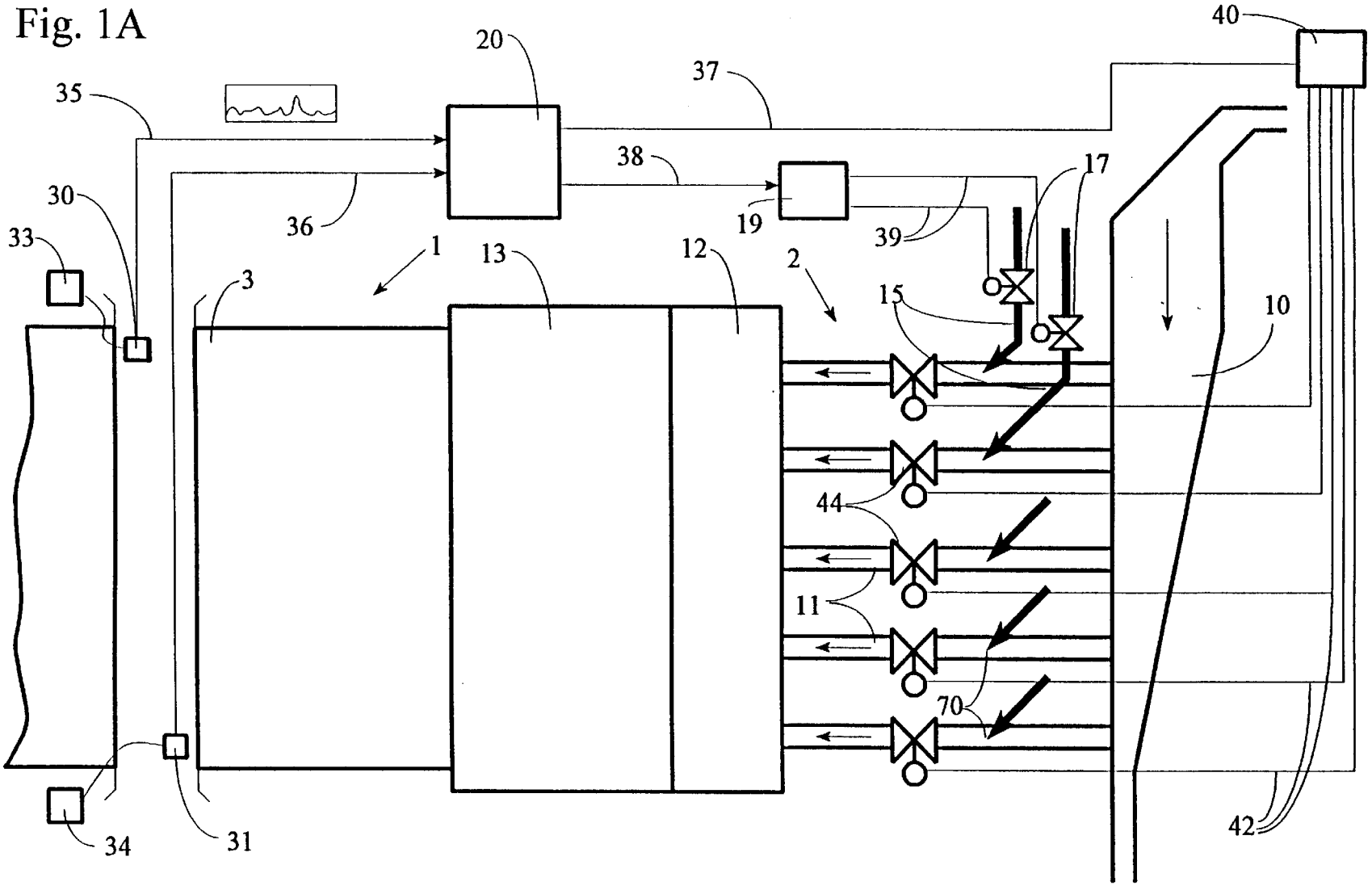
FIG. 1A schematically shows an alternate embodiment of the machine part in FIG. 1 with a different inflow control.
Figure 1B:
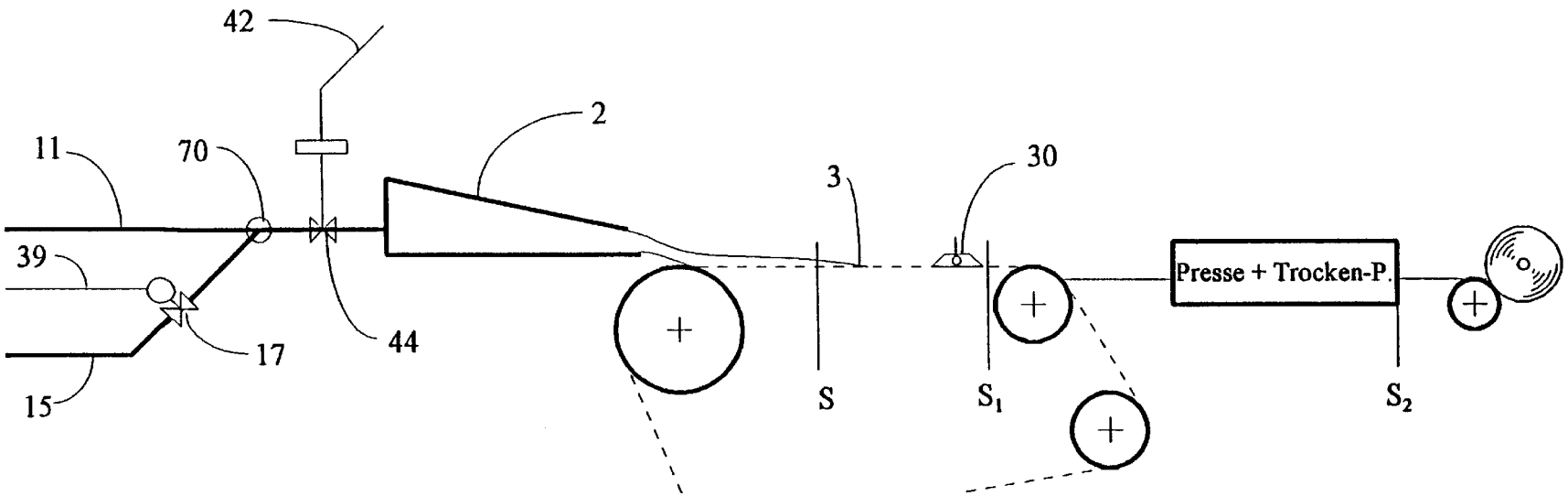
FIG. 1B is a schematic side view of a floxbow arrangement for one section across the machine.

In the alternate embodiment shown in FIGS. 1A and 1B, a respective control valve 44 is provided in the respective feed line 11 for each section in order to control the total amount of stock suspension in the section. The actuator associated with each valve is driven via respective control lines 42 by the controller for the machine direction profile control 40.

The suspension consistency in a feed line is set by the valve 17 in the dilution means feed line 15 for the respective section. By combining the main suspension flow at the concentration $C_i$ in the feed line 11 with a dilution flow via the dilution means feed line 15, which generally has a lower concentration $C_j$ than the main suspension flow in the respective feed line 11 upstream of the infeed point, the result is a stock suspension consistency $C_{tot}=a_i \cdot c_i+a_j \cdot c_j$ in the respective section. In this case, $a_i$, $a_j$ are the proportions of the partial flows in the respective overall section flow. The main suspension flow preferably has a proportion of 85%, that is to say $a_i=0.85$, and the dilution means flow has a proportion of 15%, that is to say $a_j=0.15$.

FIG. 1B shows schematically and in section a controlled consistency flowbox in a papermaking machine for one section, as disclosed in DE 42 39 845, which is incorporated herein by reference. Components which are identical to those in FIG. 1A are identified with the same reference symbols. The valve 44 in the feed line and the valve 17 in the dilution means feed line 15 are seen. The points S, $S_1$ and $S_2$ further along the course of the papermaking machine schematically show three points at which it is possible for the grammage or, respectively, a measured variable associated with the grammage, to be detected, preferably with the aid of a sensor.

Figure 1C:
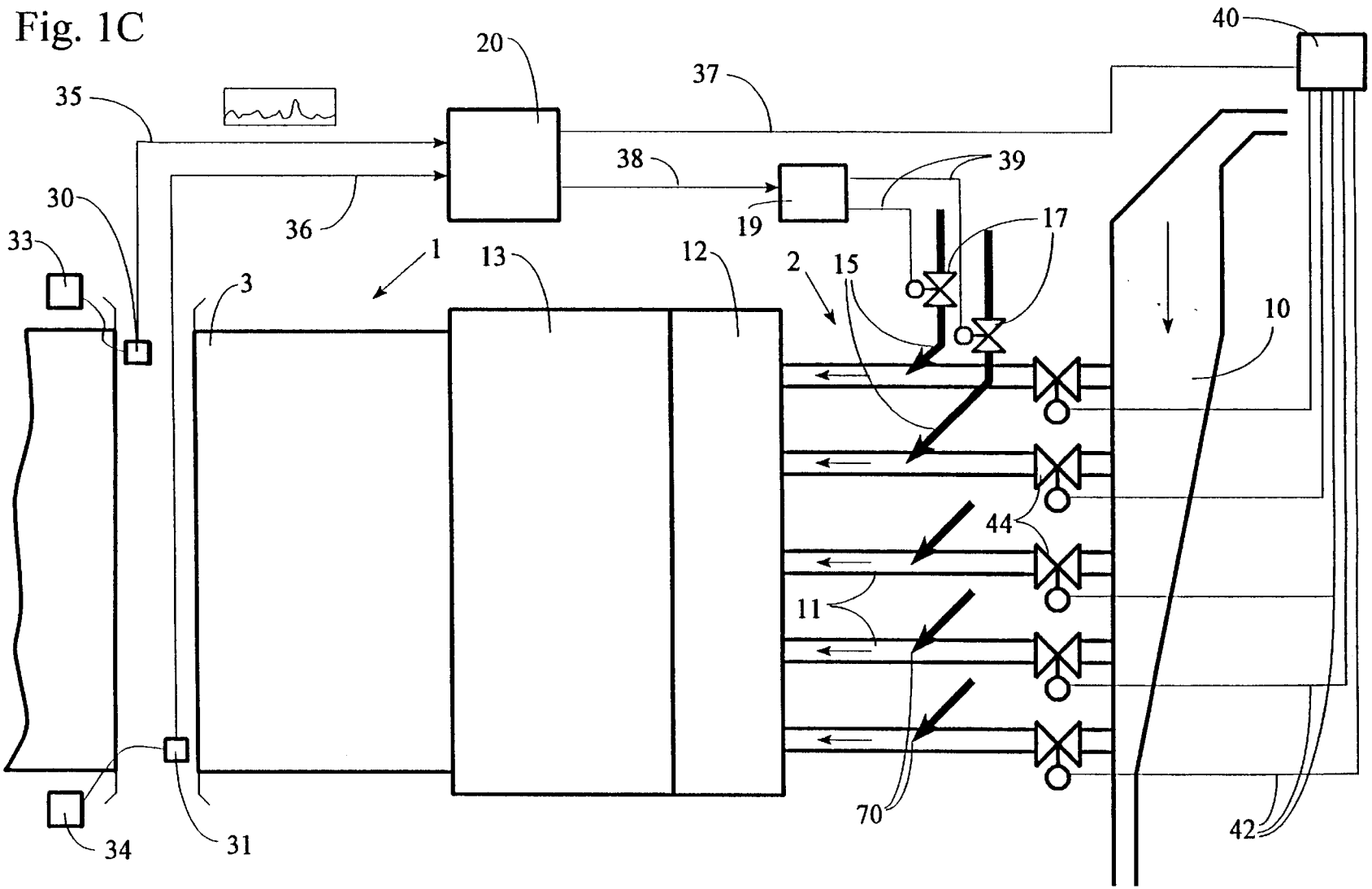
FIG. 1C schematically shows yet another embodiment of the machine part in FIG. 1 with a further different inflow control.

FIG. 1C illustrates a further variant in which the valves 44 are arranged in the feed lines 11 but still upstream of the infeed points 70 for the dilution medium, like the valve 44 in FIG. 1A. The valves 17 in the dilution means feed lines 15 are in turn driven via lines 39 by the controller for the cross-machine direction profile 19, whereas the valves 44 in the individual feed lines 11 are driven by the controller for the machine direction profile 40.

FIG. 2 illustrates the points on the paper web that are picked up by the point-like measurement points that traverse transversely to the running direction of the paper web 3, which is running in the direction of the arrow to the left. The continuous line 50 on the paper web indicates the path of points which are sampled at a predefined web speed by one of the two traversing measuring sensors, at a defined speed at which this sensor moves transversely to the running paper web. As can be seen in FIG. 2, for a running paper web it is not the cross-machine direction grammage profile which is picked up as the measured variable but a mixture of the cross-machine and the machine direction grammage profiles. If machine direction fluctuations occur, this causes the cross-machine direction grammage profile to be measurable only as a type of average over a certain distance of advance, which is designated here by $I_a$. If machine direction fluctuations occur, this produces a noisy cross-machine direction profile. The noise of this profile can be reduced if a second point-by-point sensor traverses in the opposite direction to the first sensor. The second sensor 31 follows the second path 52 of the measuring points, drawn with a broken line. As can be seen from FIG. 2, if the two sensors traverse in opposite directions, the distance between two measuring points on the paper web, is halved, as compared with picking them up using only one sensor. That smaller distance is designated in FIG. 2 by $I_b$, wherein $I_b=0.5\times I_a$.

It is possible to use more than two sensors to seek the current cross-machine direction grammage profile and/or machine direction grammage profile, and thus to increase the resolution still further.

However, using even two sensors instead of one sensor enables the cross-machine direction grammage profile and/or machine direction grammage profile to be picked up significantly more accurately than previously as representative for a quality feature in the paper manufacturing process.

Furthermore, by splitting up into a cross-machine and a machine direction profile component, for example with the aid of a difference signal, this arrangement makes it possible to draw conclusions as to the machine direction fluctuations and hence to cleanse the cross-machine direction grammage profile measurement of these machine direction fluctuations. The cross-machine direction profile can thus be determined not only more rapidly but with significantly less noise, and the cross-machine direction profile control system can intervene more frequently and also with greater amplitude than according to the prior art. It is thus possible to react more rapidly than previously to profile fluctuations, and finer control is possible. The transient time of the control system following a grade change or other disturbances is also significantly accelerated.

In addition to the illustrated embodiment having two traversing sensors, it is also possible to take only one cross-machine direction grammage and/or machine direction grammage profile measurement, instead of two independent cross-machine direction grammage and/or machine direction grammage profile measurements, and to determine a further measured variable during paper manufacture. This enables influencing or taking into account the machine direction fluctuations during the paper manufacturing process.

One possibility, for example, is to determine the consistency of the paper stock suspension as a further independent measured variable. This may be performed, for example, in the common feed to the flowbox or else in the individual feed lines to the flowbox.

Figure 3:
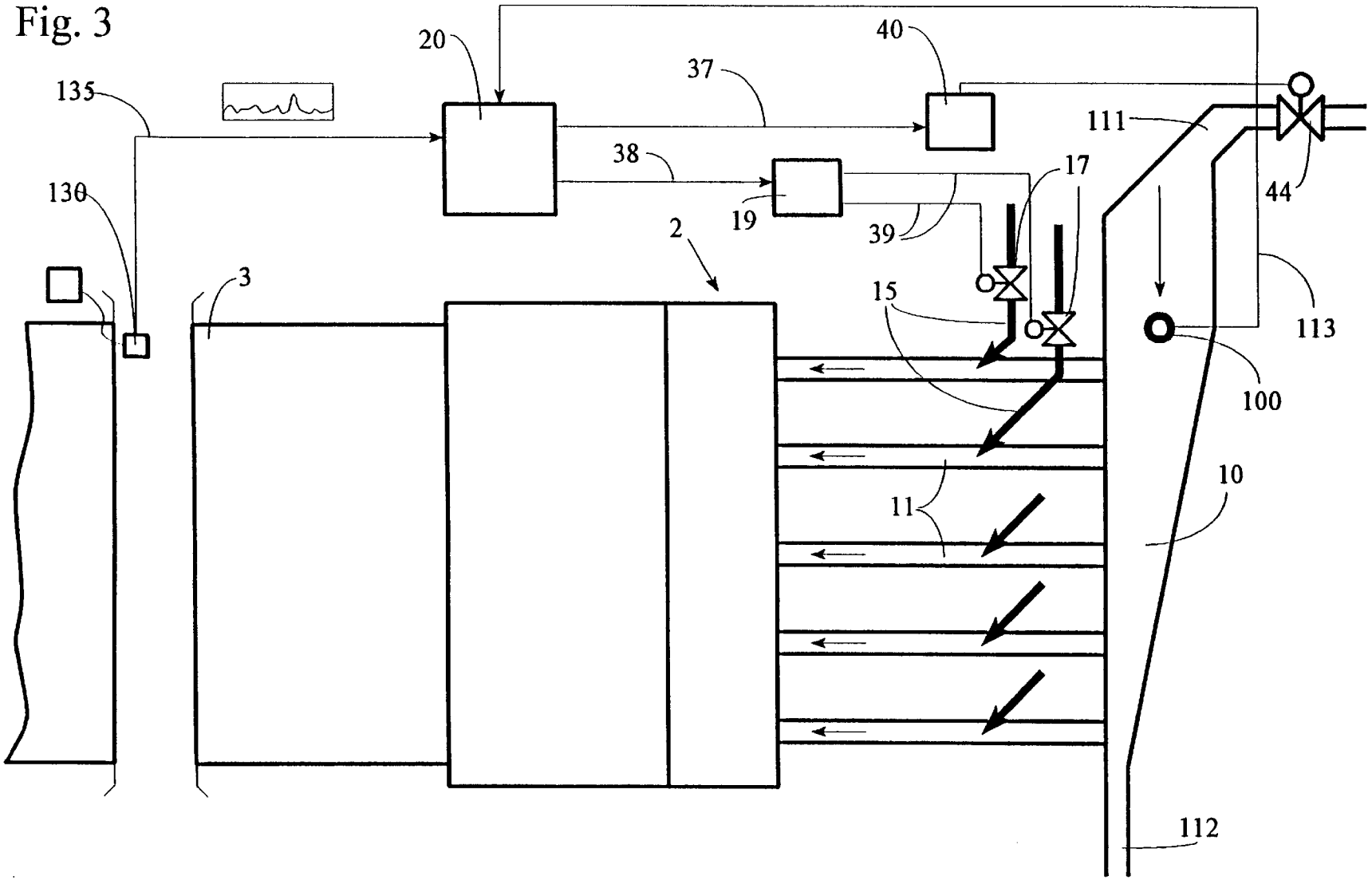
FIG. 3 schematically shows a papermaking machine with the control device according to the invention and a sensor in the flowbox.

Such an arrangement for a flowbox is shown by FIG. 3. As in FIG. 1, a papermaking machine having a controlled consistency, sectioned flowbox 2 is illustrated. Instead of having two traversing sensors, the arrangement in FIG. 3 comprises only one traversing sensor 130, which picks up a mixed cross-machine and machine direction profile of the running paper web 3, and supplies this measured signal via the measuring line 135 to the control computer 20. The sectioned flowbox is constructed as described for FIG. 1 and comprises a common feed line 10 with an inlet side 111 and an outlet side 112, as well as individual feed lines 11 to the respective sections of the flowbox. Each individual feed line is assigned a dilution means feed line 15 with a respective actuator 17. The cross-machine direction profile control is performed by the controller 19, as described for FIG. 1.

Distinguishing from FIG. 1, instead of the grammage profile, the paper stock consistency is determined as the second measured variable by means of a sensor 100, which is arranged on the inlet side of the common feed line. The paper stock consistency that is determined by means of the sensor 100 is fed via the line 113 to the control computer 20. As previously discussed, this is a pure machine direction profile signal of the quality feature of the grammage in the present example. In the control computer 20, it is necessary only for the signal which originates from the traversing measuring sensor 130 to be decomposed into a cross-machine and a machine direction component, with the aid of the second measured signal from the paper stock consistency sensor. As in the embodiment of FIG. 1, the machine direction signal component is fed via the line 37 to the controller 40 for the machine direction component. This controller, as in FIG. 1, addresses a control valve 44 arranged in the feed line. Of course, arrangements like those illustrated in FIGS. 1A, 1B and 1C are also conceivable for the flowbox in FIG. 3.

The advantage of picking up a signal in the common feed line or else at an arbitrary point at the wet end resides in the fact that significantly faster control interventions are possible.

Instead of making an accurate measurement of the paper stock consistency in the flowbox, it is also possible to pick other quality features that are characteristic of the paper manufacturing process or to determine these in addition to the cross-machine grammage profile and/or machine direction grammage profile. With respect to the relevant quality features, reference is made to the embodiments outlined at the outset.

In all of the embodiments, it is possible, by contrast with the prior art, to obtain significantly better results in the control of the flowbox of a paper web, and hence to improve the paper quality which can be achieved using this device.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A paper quality control device for controlling at least one of the cross-machine direction profile and the machine direction profile of at least one quality feature of a paper web as it is being produced in a paper making machine, the paper quality control device comprising:

a controller for receiving signals from a sensor and for driving and controlling an actuator; least one actuator which is connected with the controller and is operable by the controller for influencing at least one of the cross-machine direction profile and the machine direction profile of the at least one quality feature of the web;

at least a first sensor adapted to and positioned for picking up a first measured signal of at least one of a first cross-machine direction profile and a first machine direction profile of a first quality feature of the paper web, the first sensor being connected with the controller for supplying a first signal to the controller;

at least a second sensor spaced from the first sensor in the machine direction adapted for picking up a second measured signal of a second cross-machine direction profile and a second machine direction profile of a second quality feature of the web, the second sensor being connected with the controller for supplying a second signal to the controller;

the controller receiving signals from the first and second sensors and being adapted to drive the actuator to adjust or control at least one of the cross-machine direction and machine direction profiles of the one quality feature of the web.

2. The control device of claim 1, wherein the first and second sensors differ such that the second measured signal picked up by the second sensor differs from the first measured signal picked up by the first sensor.

3. The control device of claim 2, wherein the first and second sensors move along the cross-machine direction.

4. The control device of claim 3, wherein the first and second sensors include means enabling moving in opposite directions at least part of the time.

5. The control device of claim 2, wherein at least one of the sensors moves along the cross-machine direction.

6. The control device of claim 2, wherein the first sensor moves along the cross-machine direction and the second sensor is in a fixed position with reference to the movement of the paper web past the second sensor and with reference to the moving by the first sensor.

7. The control device of claim 2, wherein the controller is operable for splitting the first and second measured signals into a machine direction signal component and a cross machine direction signal component.

8. The control device of claim 7, wherein the controller comprises:

a machine direction controller part to which the machine direction signal component is fed;

a cross machine direction controller part to which the cross machine direction signal component is fed;

the actuator includes a machine direction component actuator connected with the machine direction controller part; and the actuator further includes a cross machine direction component actuator connected with the cross-machine direction controller part.

9. The control device of claim 1, being located on a paper making machine having a wet end; and the second sensor is arranged toward the wet end of the paper making machine to measure the respective one of the cross machine direction profile and the machine direction profile of the quality feature and to measure it at the wet end of the machine.

10. The control device of claim 1, further comprising a feed device including at least one feed line delivering pulp suspension to the machine and a paper making machine flowbox which receives the suspension from the at least one feed line;

the second sensor is arranged in at least one of the feed lines to the flowbox.

11. The control device of claim 1, further comprising a feed device including at least one feed line delivering pulp suspension to the machine and a paper making machine flowbox which receives the suspension from the at least one feed line;

the flowbox having a common feed line leading to the feed lines to the flowbox; and the second sensor being in the common feed line.

12. The control device of claim 1, wherein the at least one quality feature is selected from the group consisting of the paper formation, the ash content, the paper thickness, the moisture of the paper web at the sensor, the opacity of the paper web at the sensor, the roughness of the paper web at the sensor, the mechanical sheet properties of the paper web at the sensor, the grammage profile of the paper web at the sensor, and the fiber orientation of the web at the sensor.

13. The control device of claim 1, wherein the at least one quality feature is selected from the group consisting of the grammage profile of the paper web and the fiber orientation of the paper web; and the second sensor is selected from the group consisting of a paper stock consistency sensor, a grammage sensor, a layer thickness sensor, and a mass flow per unit area sensor.

14. A paper quality control device for controlling at least one of the cross-machine direction profile and the machine direction profile of at least one quality feature of a paper web as it is being produced in a paper making machine, the paper quality control device comprising:

a controller for receiving signals from a sensor and for driving and controlling an actuator;

at least one actuator which is connected with the controller and is operable by the controller for influencing at least one of the cross-machine direction profile and the machine direction profile of the at least one quality feature of the web;

at least a first sensor for picking up a first measured signal of at least one of a first cross machine direction profile and a first machine direction profile of the quality feature of the paper web being produced and for supplying the first signal to the controller;

at least a second sensor spaced in the machine direction from the first sensor for picking up a second measured signal of at least one of a second cross-machine direction profile a second machine direction profile related to one of the quality features of the web and for supplying the second signal to the controller;

at least one of the first and second sensors moves along the cross-machine direction;

the controller receiving signals from the first and second sensors and being adapted to drive the actuator to adjust or control at least one of the cross-machine direction and machine direction profiles of the one quality feature of the web.

15. The control device of claim 14, wherein both of the first and second sensors move along the cross-machine direction.

16. The control device of claim 15, wherein the first and second sensors include means enabling them to move in opposite directions at least part of the time.

17. The control device of claim 14, wherein the controller is operable for splitting the first and second measured signals into a machine direction signal component and a cross-machine direction signal component.

18. The control device of claim 17, further comprising:

a machine direction controller part to which the machine direction signal component is fed;

a cross machine direction controller part to which the cross machine direction signal component is fed;

the actuator includes a machine direction component actuator connected with the machine direction controller part; and the actuator further includes a cross machine direction component actuator connected with the cross-machine direction controller part.

19. The control device of claim 18, wherein the cross machine direction component actuator comprises a controlled consistency flowbox for suspension.

20. The control device of claim 19, further comprising dilution feed lines into the flowbox for feeding paper stock suspension; and the controlled consistency flowbox comprises a control valve in each dilution means feed line for the paper stock suspension.

21. The control device of claim 14, wherein the device is located on a paper making machine having a wet end; and the second sensor is arranged toward the wet end of the paper making machine to measure the respective one of the cross machine direction profile and the machine direction profile of the quality feature at the wet end of the machine.

22. The control device of claim 14, further comprising a feed device including at least one feed line delivering pulp suspension to the machine; a paper making machine flowbox which receives the suspension from the at least one feed line; and the second sensor is arranged in at least one of the feed lines to the flowbox.

23. The control device of claim 14, wherein the quality feature is selected from the group consisting of the paper formation, the ash content, the paper thickness, the moisture of the paper web at the sensor, the opacity of the paper web at the sensor, the roughness of the paper web at the sensor, the mechanical sheet properties of the paper web at the sensor, the grammage profile of the paper web at the sensor, and the fiber orientation of the web at the sensor.

24. The control device of claim 14, wherein the quality feature is selected from the group consisting of the grammage profile of the paper web and the fiber orientation of the paper web; and the second sensor is selected from the group consisting of a paper stock consistency sensor, a grammage sensor, a layer thickness sensor, and a mass flow per unit area sensor.

25. A paper quality control device for controlling at least one of the cross-machine direction profile and the machine direction profile of at least one quality feature of a paper web as it is being produced in a paper making machine, the paper quality control device comprising:

a controller for receiving signals from a sensor and for driving and controlling an actuator;

at least one actuator which is connected with the controller and is operable by the controller for influencing at least one of the cross-machine direction profile and the machine direction profile of the at least one quality feature of the web;

a first sensor adapted to and positioned for picking up a first measured signal of the cross-machine direction profile of a first quality feature of the paper web, the first sensor being connected with the controller for supplying a first signal to the controller;

a second sensor adapted to and positioned at a spaced position in the machine direction from the first sensor for picking up a second measured signal of the machine direction profile of the first quality feature of the web, the second sensor also being connected with the controller for supplying a second signal to the controller;

the controller receiving signals from the first and second sensors and being adapted to drive the actuator to adjust or control at least one of the cross-machine direction and machine direction profiles of the one quality feature of the web.

26. A method for control of one of a cross-machine direction profile and a machine direction profile of a quality feature of a paper web in a paper manufacturing process, the method comprising:

measuring at least one of a first cross machine direction profile and a first machine direction profile of the one quality feature at least one point on a paper making machine on which the process is performed;

picking up at a second point spaced in the machine direction from the first point at least one further measured variable that is characteristic of at least one of a second cross machine direction profile and a second machine direction profile of a second quality feature;

processing the measurements of the profiles; and using the processed measurements for influencing at least one of the cross machine direction profile and the machine direction profile of one of the measured quality features in the paper manufacturing process.

27. The method of claim 26, further comprising splitting the measurements of the profiles in a computer into a machine direction component signal and a cross-machine direction component signal, and using the split signal for influencing the selected profile of the one measured quality feature.

28. The method of claim 26, further comprising feeding the machine direction component signal to a controller for the machine direction component and feeding the cross-machine direction component signal to a controller for the cross-machine direction component.

29. The method of claim 26, wherein the controller for the cross machine direction component operates a controlled consistency flowbox for influencing the cross machine direction profile.

30. The method of claim 29, wherein the controlled consistency flowbox, for the paper stock suspension comprises a plurality of dilution means feed lines and a control valve in each dilution means feed line;

the method further comprising controlling the valve in each of the dilution means feed lines for controlling the pulp consistency in each of the feed lines.

31. The method of claim 27, wherein the controlled consistency flowbox, for the paper stock suspension comprises a plurality of dilution means, feed lines and a control valve in each dilution means feed line;

the method further comprising controlling the valve in each of the dilution means feed lines for controlling the pulp consistency in each of the feed lines.

32. A method for control of one of a cross-machine direction profile and a machine direction profile of a quality feature in a paper manufacturing process, the method comprising:

measuring at least two different profiles, each being spaced from the other in the machine direction having a respective cross machine direction component and a respective machine direction component, of at least one quality feature of a web being produced in a paper making machine;

processing the measured signals for calculating the pure cross machine direction profile and the pure machine direction profile of the at least one quality feature;

using the signals as to the profiles for influencing at least one of the cross machine direction profile and the machine direction profile of the at least one quality feature in the paper manufacturing process.

33. The method of claim 32, further comprising feeding the machine direction component signal to a controller for the machine direction component and feeding the cross-machine direction component signal to a controller for the cross machine direction component.

34. The method of claim 28, wherein the controller for the cross machine direction component operates a controlled consistency flowbox for influencing the cross machine direction profile.

* * * * *